US009435617B2

(12) United States Patent
Gamerman et al.

(10) Patent No.: US 9,435,617 B2
(45) Date of Patent: Sep. 6, 2016

(54) AUDIBLE TARGETING SYSTEM

(71) Applicants: Valentin M. Gamerman, Gates Mills, OH (US); Boris B. Tolstykh, Aurora, OH (US)

(72) Inventors: Valentin M. Gamerman, Gates Mills, OH (US); Boris B. Tolstykh, Aurora, OH (US)

( * ) Notice: Subject to any disclaimer, the term of this patent is extended or adjusted under 35 U.S.C. 154(b) by 0 days.

(21) Appl. No.: 14/788,875

(22) Filed: Jul. 1, 2015

(65) Prior Publication Data

US 2016/0123708 A1 May 5, 2016

Related U.S. Application Data

(60) Provisional application No. 62/072,057, filed on Oct. 29, 2014.

(51) Int. Cl.

| | |
|---|---|
| ***F41J 5/044*** | (2006.01) |
| ***F41J 5/14*** | (2006.01) |
| ***F41J 5/18*** | (2006.01) |
| ***F41J 5/24*** | (2006.01) |
| ***F41J 5/20*** | (2006.01) |
| *F41J 5/04* | (2006.01) |

(52) U.S. Cl.

CPC .. *F41J 5/24* (2013.01); *F41J 5/18* (2013.01); *F41J 5/20* (2013.01); *F41J 5/04* (2013.01)

(58) Field of Classification Search

CPC ..... F41J 7/00; F41J 5/052; F41J 5/056; F41J 5/042; F41J 5/04; F41J 5/041; F41J 5/14; F41J 5/18; F41J 5/20; A63F 9/0204; A63F 2250/028; A63B 2071/0625

USPC ..... 273/371–377, 398–408, 390–392

See application file for complete search history.

(56) References Cited

U.S. PATENT DOCUMENTS

| | | | | | |
|---|---|---|---|---|---|
| 1,008,874 | A * | 11/1911 | Taylor | A63F 9/0204 | 273/381 |
| 1,098,255 | A * | 5/1914 | Harper | F41J 7/04 | 273/392 |
| 1,126,024 | A * | 1/1915 | Johnson | A63F 9/0204 | 273/381 |
| 1,305,653 | A * | 6/1919 | Lassallle | A63F 9/0204 | 273/382 |
| 1,733,606 | A * | 10/1929 | Junker | A63F 9/02 | 273/371 |
| 2,469,061 | A * | 5/1949 | Barto | A63B 63/00 | 273/381 |
| 3,411,784 | A * | 11/1968 | Lawrence | F41J 7/04 | 273/388 |
| 4,266,776 | A * | 5/1981 | Goldfarb | F41J 5/02 | 273/406 |

(Continued)

OTHER PUBLICATIONS

Matthew Waterman and Donato Salazar; Electronic Target; (article) Dec. 8, 2011.

*Primary Examiner* — Mark Graham

(74) *Attorney, Agent, or Firm* — Buckingham, Doolittle & Burroughs, LLC

(57) ABSTRACT

An audible target system for measuring the accuracy of shooting projectiles with an air gun or other device is disclosed. The audible targeting system comprises a target component, a computer, and a software program capable of interpreting the results. The target component comprises a plurality of targets that a user attempts to hit with a projectile fired from a shooting device. Once struck, each of the plurality of targets engages a mallet that in turn strikes a resonant member which emits one of a plurality of audible tones. Furthermore, instead of a mallet and a resonant member, the plurality of targets can comprise an area switch with a momentary contact. Thus, the target when engaged by a projectile would produce a sound through the process of an electric switch engaging an electrical circuit. Once the electrical circuit is closed, a sound is emitted from speakers integrated in the target.

12 Claims, 3 Drawing Sheets

(56) References Cited

U.S. PATENT DOCUMENTS

| | | | | |
|---|---|---|---|---|
| 4,397,468 | A * | 8/1983 | D'Andrade | A63F 9/0204 273/381 |
| 4,524,976 | A * | 6/1985 | Seitz | F41J 7/04 273/388 |
| 4,588,194 | A * | 5/1986 | Steidle | F41J 7/04 273/391 |
| 4,786,058 | A | 11/1988 | Baughman | |
| 5,095,433 | A | 3/1992 | Botarelli et al. | |
| 5,536,017 | A * | 7/1996 | Salisian | A63F 9/0204 273/375 |
| 5,908,194 | A * | 6/1999 | Schachter | A63B 24/0021 273/372 |
| 5,988,645 | A | 11/1999 | Downing | |
| 6,347,798 | B1 * | 2/2002 | Quiring | F41J 7/04 273/391 |
| 6,896,267 | B1 * | 5/2005 | Le Anna | F41J 7/04 273/391 |
| 7,690,656 | B2 | 4/2010 | Saunders | |
| 8,105,087 | B2 | 1/2012 | Valentini | |
| 8,262,473 | B2 * | 9/2012 | Civettini | A63F 9/02 273/348 |
| 8,356,818 | B2 | 1/2013 | Mraz | |
| 8,360,776 | B2 | 1/2013 | Manard et al. | |
| 8,523,185 | B1 | 9/2013 | Gilbreath et al. | |
| 8,764,016 | B2 | 7/2014 | Stewart | |
| 2002/0183141 | A1 * | 12/2002 | Ouimette | A63B 63/06 473/454 |
| 2003/0082502 | A1 | 5/2003 | Stender et al. | |
| 2005/0017456 | A1 | 1/2005 | Shechter | |
| 2009/0194943 | A1 | 8/2009 | Amitai | |
| 2010/0038854 | A1 * | 2/2010 | Mraz | F41J 5/056 273/371 |
| 2010/0320691 | A1 * | 12/2010 | McNelis | F41J 5/06 273/371 |
| 2011/0248448 | A1 | 10/2011 | Hodge | |
| 2012/0258432 | A1 | 10/2012 | Weissler | |
| 2013/0009364 | A1 | 1/2013 | Forness et al. | |
| 2013/0147117 | A1 | 6/2013 | Graham et al. | |
| 2013/0193645 | A1 | 8/2013 | Kazakov et al. | |
| 2014/0315156 | A1 | 10/2014 | Averill | |
| 2015/0145213 | A1 * | 5/2015 | Chiu | F41J 5/18 273/377 |

* cited by examiner

AUDIBLE TARGETING SYSTEM

CROSS-REFERENCE

This application claims priority from Provisional Patent Application Ser. No. 62/072,057 filed Oct. 29, 2014.

FIELD OF THE INVENTION

This invention pertains generally to a target for use with an air gun or firearms, and more particularly to an air gun targeting system comprising an audible component that emits sounds that are captured and analyzed for targeting accuracy by a computer software program.

BACKGROUND

Targets are frequently used by shooters to determine the accuracy of shooting. A device such as an air gun or pellet gun fires a projectile such as a pellet or a BB using a compressed gas or other means. To determine or improve accuracy, shooters often use targets. Traditional targets typically comprise a piece of paper or cardboard stock with a target design inscribed on the paper to allow the user to determine the accuracy of a shot. The shooter simply takes aim at the target and fires the projectile. Accuracy is then determined by measuring the distance that the projectile struck the target from the point on the target where the shooter aimed. While the shooter may have a general idea of the results while shooting, to precisely determine accuracy the shooter must finish shooting and retrieve the target to visually inspect the result from close range. While the shooter may hear an audible sound of the projectile striking the target, the sound provides no indication of how accurate the shot was other than that the target was struck somewhere.

Consequently, there exists a need for a targeting system that allows a shooter to instantly determine the accuracy of a shot while receiving positive reinforcement in the form of an audible tone. The present invention discloses an audible targeting system for use with an air gun, airsoft gun, firearm, and the like, or any shooting device that can propel a projectile, such as but not limited to a sling shot, Nerf® gun, and the like. The disclosed targeting system allows a user to immediately know the accuracy of each shot, while simultaneously capturing the results on a smart phone or other computing device for additional analysis such as conducting a competition between more than one shooter. This enables a shooter to speed up target practice while enjoying the positive reinforcement of a successful shot by hearing a sound emitted from the target or from the software. Additionally, the software can provide options for shooters to compete not only against previous results, but against other shooters as well.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an audible target system for measuring the accuracy of shooting projectiles with an air gun or other device. The audible targeting system comprises a target component, a computer, and a software program capable of interpreting the results. The target component comprises a plurality of targets that a user attempts to hit with a projectile fired from an air gun, airsoft gun, firearm, and the like, or any shooting device that can propel a projectile. Once struck, each of the plurality of targets engages one of a plurality of mallets that in turn strike one of a plurality of resonant members which emit one of a plurality of audible tones. Hearing one of the pluralities of audible tones informs the shooter and the software program of a successful shot.

Furthermore, in a preferred embodiment of the invention the targeting system further comprises a computer, such as a smart phone, with a microphone for detecting the plurality of audible tones produced by the plurality of resonant members following an accurate shot. Additionally, the targeting system further comprises a software program that can differentiate between the pluralities of tones and indicate which of the plurality of targets was struck by a particular shot. The software may also record the results and compare with prior results or compare with the results of other shooters during a competition or tournament. In a preferred embodiment, the software detects a primary frequency emitted by one of the struck resonant members. Each resonant member may comprise a primary frequency unique to that resonant member. The primary frequency is captured by the software during a calibration preformed when the software is configured prior to use. Additionally, each of the primary frequencies last a specific duration. The software is configurable to account for the frequency and duration of each sound thereby eliminating ancillary sounds that do not come from a successful strike of a resonant member.

In another embodiment of the invention, instead of a plurality of mallets that strike one of a plurality of resonant members to emit one of a plurality of audible tones, the plurality of targets comprise an area switch with a momentary contact. Thus, the target when engaged by a projectile would produce a sound through the process of an electric switch or sensor engaging an electrical circuit. Once the electrical circuit is closed, a sound is emitted from speakers integrated in the target. Hearing an audible tone, informs the shooter and the software program of a successful shot. Furthermore, a computer, such as a smart phone, comprises a microphone for detecting the sound emitted from the speakers following an accurate shot. Additionally, the targeting system further comprises a software program that can differentiate between the pluralities of tones and indicate which of the plurality of targets was struck by a particular shot. The software may also record the results and compare with prior results or compare with the results of other shooters during a competition or tournament.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
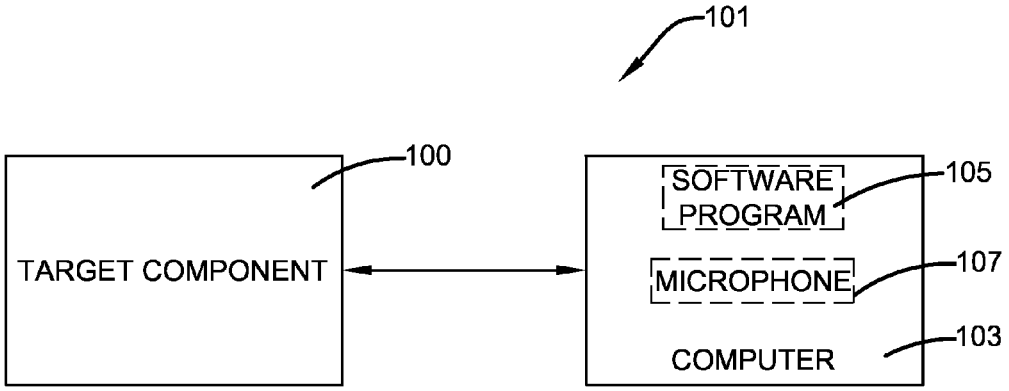
FIG. 1 illustrates a block diagram of the targeting system wherein mallets and resonant members are used to produce an audible tone in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter. The invention relates generally to a targeting system for determining the accuracy and/or speed of shooting of a target shooter.

Figure 2:
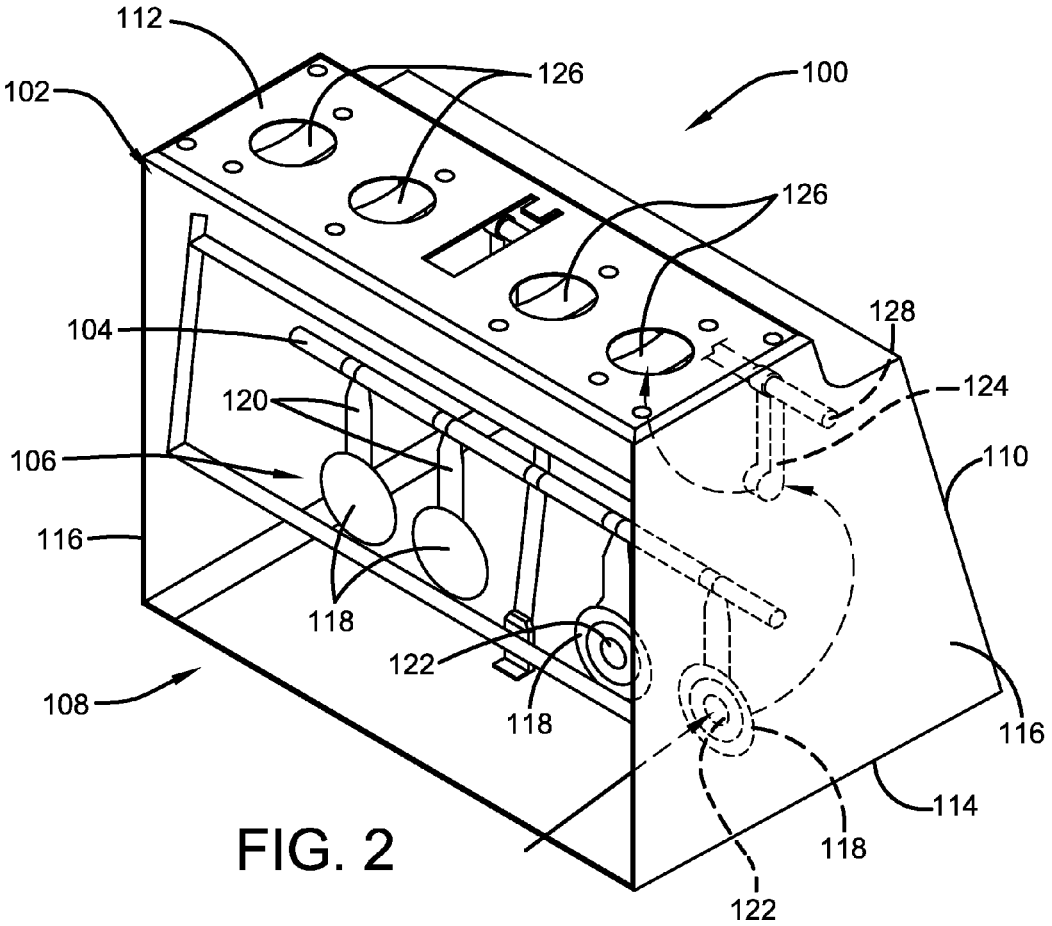
FIG. 2 illustrates a front perspective view of the target component of the targeting system in accordance with the disclosed architecture.
Figure 3:
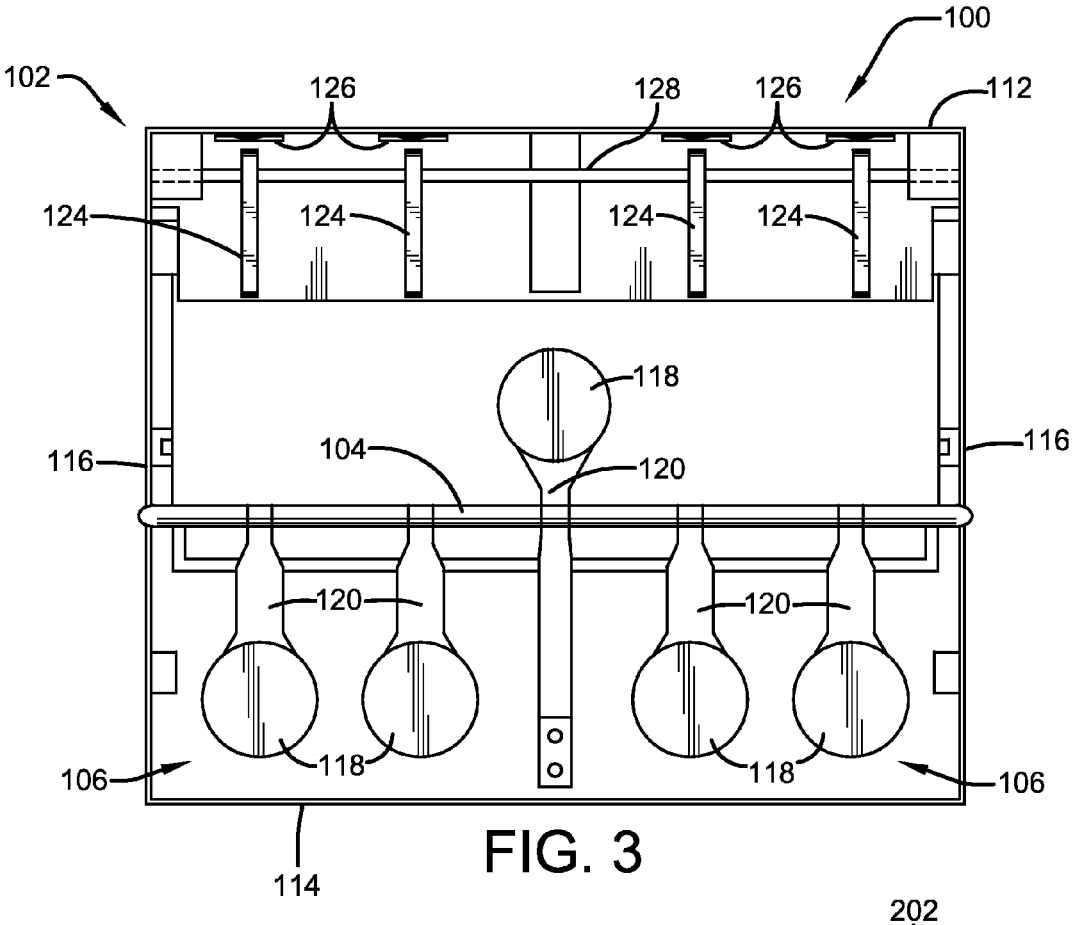
FIG. 3 illustrates a back perspective view of the target component of the targeting system in accordance with the disclosed architecture.

Referring initially to the drawings, FIG. 1 illustrates a targeting system 101 for use with a shooting device. The targeting system 101 comprises a target component 100, and a computer 103 comprising a software program 105 and a microphone 107. As shown in FIGS. 2-3, the target component 100 comprises a housing 102, a support rod 104, and a plurality of targets 106. The housing 102 is typically a metal or plastic enclosure with one open side (i.e., open front side 108) for receiving projectiles fired from a shooting device that can propel a projectile, such as but not limited to an air gun, airsoft gun, firearm, and the like, or any device that can propel a projectile, such as but not limited to a sling shot, Nerf® gun, and the like. Typical projectiles comprise pellets, BBs, darts, bullets, and the like, or any other projectile fired from a shooting device. The support rod 104 is typically a metal bar that generally transects the housing from side to side running parallel to a bottom side 114 of the housing 102.

The housing 102 typically comprises a top side 112, a bottom side 114, opposing sides 116, an open front side 108, and a closed back side 110. Generally, the housing 102 is rectangular in shape, however, the housing 102 can be any suitable size, shape, and configuration as is known in the art without affecting the overall concept of the invention. One of ordinary skill in the art will appreciate that the shape and size of the housing 102 as shown in FIGS. 2-3 is for illustrative purposes only and many other shapes and sizes of the housing 102 are well within the scope of the present disclosure. Although dimensions of the housing 102 (i.e., length, width, and height) are important design parameters for good performance, the housing 102 may be any shape or size that ensures optimal performance during use.

The plurality of targets 106 each comprise a target portion 118 and an arm portion 120 and are typically shaped as flattened metal paddles, spoons, pedals, silhouettes, and the like. The plurality of targets 106 each further comprises a bull's-eye 122 or other similar target indicator painted onto or otherwise affixed to an outward facing side of the target portion 118. The arm portion 120 of each of the plurality of targets 106 is rotatable attached to the support rod 104 so that a struck target will revolve around the support rod 104. When one of the pluralities of targets 106 is struck by a projectile, it rotates away from the opening (i.e., open front side 108) in the housing 102 and disappears from the view of the shooter, thus giving the shooter a visual indication that a target was hit.

The target component 100 further comprises a plurality of mallets 124 and a plurality of resonant members 126. The plurality of mallets 124 are typically strikers positioned within the housing 102 toward a top side 112 of the housing 102. The target component 100 may further comprise a mallet support rod 128 configured similar to the support rod 104 for the plurality of targets 106 that transects the housing 102 near the interior, top side 112. The plurality of mallets 124 are free hanging from the mallet support rod 128, and are rotatably attached to the mallet support rod 128 so that a struck target will contact the free hanging mallet 124 causing it to rotate up toward the interior, top side 112 of the housing 102 till the mallet 124 contacts a resonant member 126.

The plurality of resonant members 126 are typically metal bars, such as but not limited to zinc plated steel, xylophone bars, chimes, and the like, or any other type of bar or plate capable of producing a plurality of audible tones once struck. Each of the plurality of resonant members 126 is typically a different length, thickness, or configuration, so that each of the plurality of resonant members 126 will generate a different frequency tone or multiple tones of different durations that are differentiable from the tone produced by each of the other of the plurality of resonant members 126. The plurality of resonant members 126 are typically secured to the interior, top side 112 of the housing via any suitable securing means as is known in the art.

In a preferred embodiment the number of each of the plurality of targets 106, the plurality of mallets 124, and the plurality of resonant members 126 is four. Although the inventor envisions embodiments of between four and twelve targets 106, mallets 124, and resonant members 126. To use the target, the user shoots the projectile striking one of the pluralities of targets 106. The struck target then rotates backward around the support rod 104 and engages the corresponding mallet 124. As the force is transferred to the mallet 124, the mallet 124 strikes the corresponding resonant member 126. Once struck, the corresponding resonant member 126 vibrates producing an audible tone. The user knows that the shot was accurate instantly upon hearing the audible tone providing immediate positive reinforcement.

Figure 4:
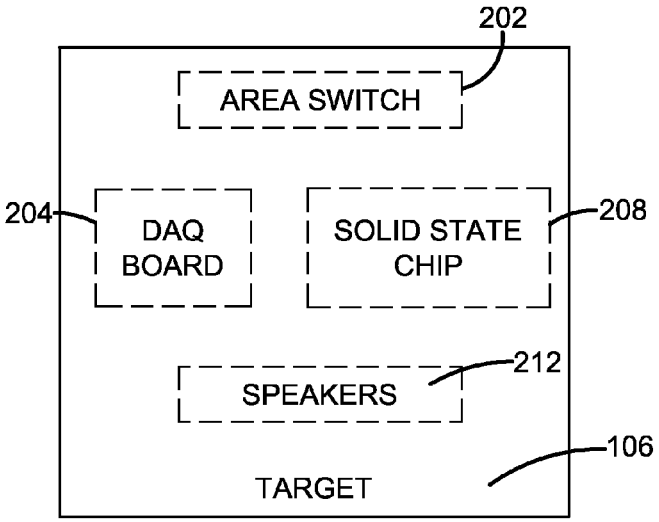
FIG. 4 illustrates a block diagram of the targeting system wherein an electrical circuit is used to produce an audible tone in accordance with the disclosed architecture.

In another embodiment as shown in FIG. 4, each of the plurality of targets 106 comprises an area switch 202 with a momentary contact. Thus, the target 106 when engaged by a projectile would produce a sound through the process of an electric switch or sensor engaging an electrical circuit. Once the electrical circuit is closed, a sound is emitted from speakers 212 built into the target.

For example, each zone or area of the target 106 comprises an area switch 202 with a momentary contact. The area switch 202 could be two plastic substrates or other suitable substrates, which have a thin layer of electrically conductive material silkscreened on the substrates. Typically, the electrically conductive material is copper, but could be any other suitable conductive material as is known in the art. One of the substrates would have a set of raised bumps or ridges, these bumps or ridges would not contain any conductive material. The substrates are then aligned such that the sides with the layer of electrically conductive material are facing each other. However, the bumps or ridges on one of the substrates prevents the substrates and the electrically conductive material from contacting or touching. The impact of the projectile striking the zone or area of the target causes the substrates to press together, closing the gap and allowing the electrically conductive material to touch which completes the circuit. Once the circuit closes, a specific voltage is sent to a Data Acquisition Board (DAQ board) 204 and/or solidstate chip 208 that is integrated into the target 106. The DAQ board 204 is a pre-programmed DAQ board for interpreting the voltage or amperage sent from the closed circuit. The DAQ board 204 performs instructions as programmed and then sends an output to a speaker 212 to emit a specific tone. Additionally, the DAQ board 204 is not needed to collect data and different sounds can be produced by sending voltage through different condesator/resistor combinations as is known in the art.

Furthermore, the targeting system 100 can be a basic unit wherein the DAQ board 204 and/or the solidstate chip 208 are integrated into the target housing, such that the DAQ board 204 and/or solidstate chip 208 is pre-programmed with a set of pre-recorded tones to match the plurality of audible tones that are generated by area switches 202. The DAQ board 204 and/or solidstate chip 208 then sends output to speakers 212 integrated into the target housing to emit the audible tones. Thus, different areas of the target 106 can produce different sounds through the same speakers 212.

Figure 5:
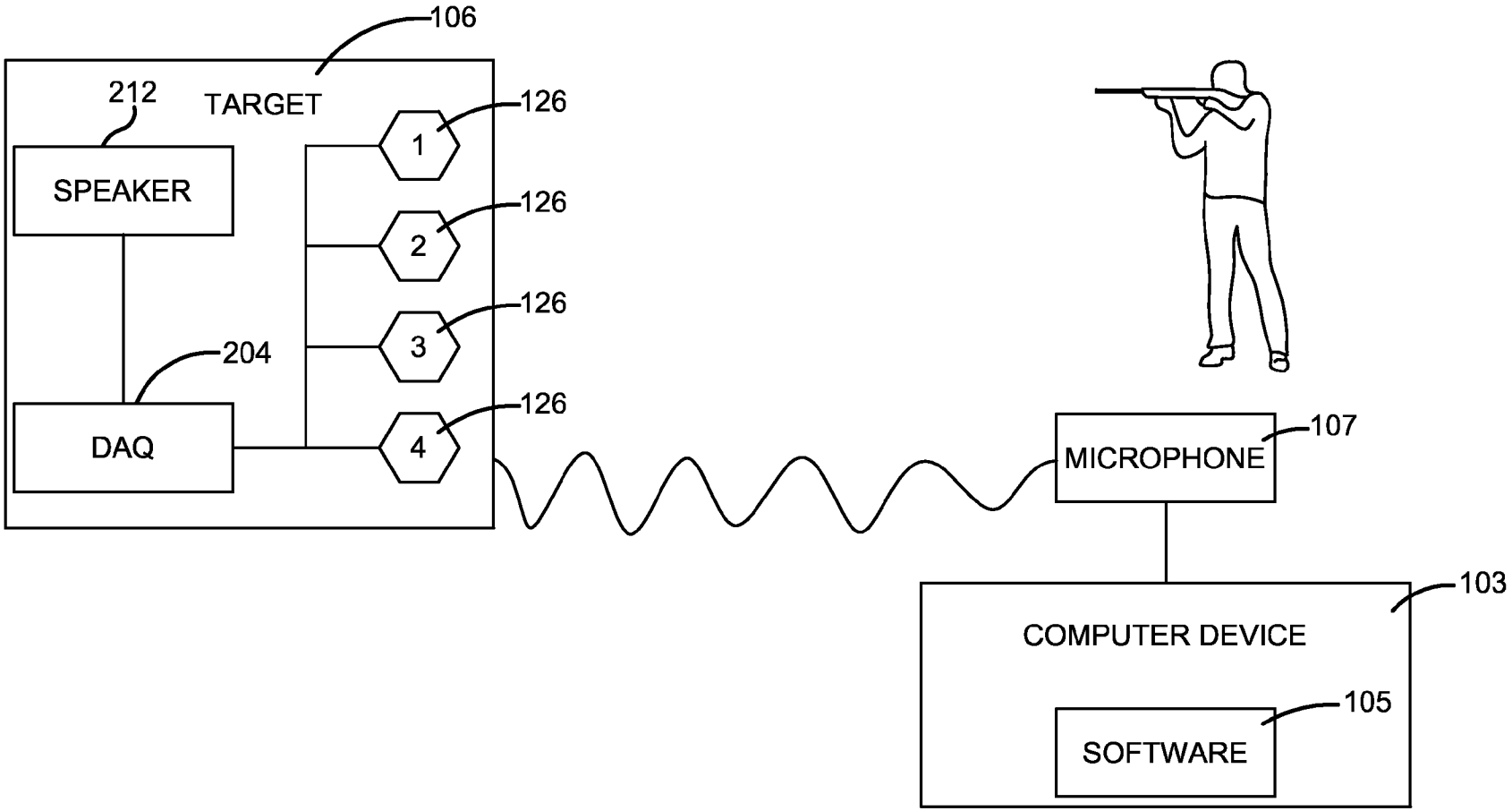
FIG. 5 illustrates a perspective view of the targeting system in use in accordance with the disclosed architecture.

In either embodiment of the target system, a computer 103 is used to capture the plurality of audible tones or other output as shown in FIG. 5. Further, the computer 103 comprises a microphone 107 capable of detecting and capturing the plurality of audible tones or other output. The computer 103 may comprise a laptop, a smart phone, a tablet, a phablet, or any other type of computing device. The software program 105 may comprise a phone app or other similar program that is executable by the computer 103. The software program 105 is programmed with a pre-recorded set of tones that may be either pre-recorded in the software to uniquely match to the resonant members 126, or that are recorded during a calibration completed by an end user. In either case, the pre-recorded set of tones will match the plurality of audible tones that are generated by the plurality of resonant members 126. Once a tone is detected by the microphone 107, the program 105 analyzes the sound characteristics, such as but not limited to frequency, duration, timber, loudness, and the like, compares it to the pre-recorded set of tones, and determines which of the plurality of targets 106 was struck by the projectile.

The software program 105 may further allow the shooter to track accuracy and speed of shooting during a shooting session and to compare the results with prior and future sessions to chart improvement over time. Similarly, more than one shooter may be analyzed simultaneously during a competition or tournament. Additional information such as speed of shooting or order of shooting targets may be tracked and recorded as well.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A targeting system for use with a shooting device comprising:

a target component comprising:

a housing;

a support rod transecting the housing;

a plurality of targets rotatably attached to and suspended from the support rod; and a plurality of mallets positioned within the housing, wherein when the plurality of targets are struck by a projectile, the plurality of targets rotate around the support rod and engage the plurality of mallets.

2. The targeting system of claim 1, further comprising a plurality of resonant members attached to the housing, wherein when the plurality of mallets are engaged, the plurality of mallets strike the plurality of resonant members to generate a plurality of audible tones.

3. The targeting system of claim 2, wherein each of the plurality of resonant members is a different length, thickness, or configuration, so that each of the plurality of resonant members will generate a different frequency tone or multiple tones of different durations that are differentiable from tone produced by each of the other of the plurality of resonant members.

4. The targeting system of claim 3, wherein number of each of the plurality of targets, the plurality of mallets, and the plurality of resonant members is four.

5. The targeting system of claim 4, further comprising a computer comprising a microphone for capturing the plurality of audible tones.

6. The targeting system of claim 5, further comprising a software program executable by the computer, wherein the software program differentiates between the plurality of captured tones, indicates which of the plurality of targets was struck, and records the results.

7. The targeting system of claim 6, wherein projectiles are fired from a shooting device.

8. The targeting system of claim 7, wherein the shooting device is an air gun, an airsoft gun, a firearm, a sling shot, or a Nerf® gun.

9. The targeting system of claim 8, wherein the projectiles comprise pellets, BBs, darts, and bullets.

10. A targeting system for use with a shooting device comprising:

a target component comprising:

a housing;

a support rod transecting the housing;

a plurality of targets rotatably attached to and suspended from the support rod;

a plurality of mallets positioned within the housing; and a plurality of resonant members attached to the housing;

and wherein when the plurality of targets are struck by a projectile, the plurality of targets rotate around the support rod and engage the plurality of mallets; and wherein when the plurality of mallets are engaged, the plurality of mallets strike the plurality of resonant members to generate a plurality of audible tones.

11. The targeting system of claim 10, wherein projectiles are fired from a shooting device.

12. The targeting system of claim 11, wherein the shooting device is an air gun, an airsoft gun, or a firearm.

* * * * *